US009677865B2

(12) United States Patent
Rogers

(10) Patent No.: US 9,677,865 B2
(45) **Date of Patent: *Jun. 13, 2017**

(54) PISTOL MAGAZINE HOLSTER WITH SNAG

(71) Applicant: Neil Christian Rogers, Tulalip, WA (US)

(72) Inventor: Neil Christian Rogers, Tulalip, WA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/924,431

(22) Filed: Oct. 27, 2015

(65) Prior Publication Data

US 2016/0273900 A1 Sep. 22, 2016

Related U.S. Application Data

(63) Continuation of application No. 13/904,387, filed on May 29, 2013, now Pat. No. 9,170,064.

(51) Int. Cl.

| | |
|---|---|
| ***A45F 5/02*** | (2006.01) |
| ***F42B 39/02*** | (2006.01) |
| ***F41A 35/00*** | (2006.01) |
| ***F41C 33/02*** | (2006.01) |
| ***F41C 33/04*** | (2006.01) |
| ***F41A 9/64*** | (2006.01) |
| ***F42B 39/26*** | (2006.01) |

(52) U.S. Cl.

CPC ..... *F42B 39/26* (2013.01); *A45F 5/022* (2013.01); *F41A 35/00* (2013.01); *F41C 33/0263* (2013.01); *F41C 33/041* (2013.01); *F41C 33/048* (2013.01); *F42B 39/02* (2013.01); *A45F 2200/0591* (2013.01); *F41A 9/64* (2013.01); *Y10S 224/931* (2013.01); *Y10T 24/1376* (2015.01)

(58) Field of Classification Search

CPC ..... Y10S 224/931
USPC ..... 224/182, 194, 587, 239, 931; 24/3.5; D3/262

See application file for complete search history.

(56) References Cited

U.S. PATENT DOCUMENTS

| | | | |
|---|---|---|---|
| 318,215 | A | 5/1885 | Stahl |
| 346,719 | A | 8/1886 | Capewell |
| 1,010,872 | A | 12/1911 | Dean |
| 1,756,677 | A | 4/1930 | Cook |
| 4,194,657 | A | 3/1980 | Thor |
| 4,355,440 | A | 10/1982 | Johansson |
| 4,972,524 | A | 11/1990 | Gasser |
| 5,865,357 | A | 2/1999 | Goodwin |
| 6,000,589 | A | 12/1999 | Burdine |
| 6,154,997 | A | 12/2000 | Aluotto |
| 6,213,364 | B1 | 4/2001 | Wakefield |
| 6,264,079 | B1 | 7/2001 | Skaggs |
| 6,402,001 | B1 | 6/2002 | Madarang |
| 6,763,984 | B2 | 7/2004 | Gallagher |
| 7,780,048 | B2 | 8/2010 | Howell |
| 7,805,875 | B1 | 10/2010 | Obong |
| 8,302,827 | B1 | 11/2012 | Cole |

(Continued)

*Primary Examiner* — Justin Larson

(74) *Attorney, Agent, or Firm* — Stetina Brunda Garred and Brucker

(57) ABSTRACT

A pistol magazine holster may comprise a body capable of retaining a pistol magazine, a support structure coupled to the body and adapted to secure the body to a compartment, and a snag member coupled to the body. The snag member may be adapted to retain the body within the compartment as the magazine is withdrawn.

18 Claims, 6 Drawing Sheets

(56) References Cited

U.S. PATENT DOCUMENTS

| | | | | |
|---|---|---|---|---|
| 8,371,487 | B1 | 2/2013 | Plappert | |
| 8,485,405 | B2 | 7/2013 | Crye | |
| 8,511,508 | B1 | 8/2013 | Glover | |
| 8,839,464 | B2 | 9/2014 | French | |
| 9,170,064 | B2 * | 10/2015 | Rogers | F41A 35/00 |
| 2006/0273129 | A1 | 12/2006 | Horn | |
| 2014/0021235 | A1 | 1/2014 | Hunter | |
| 2014/0027485 | A1 | 1/2014 | Van Heusen | |

* cited by examiner

PISTOL MAGAZINE HOLSTER WITH SNAG

RELATED APPLICATIONS

This application is a continuation of U.S. patent application Ser. No. 13/904,387 filed May 29, 2013 and entitled PISTOL MAGAZINE HOLSTER WITH SNAG now issued as U.S. Pat. No. 9,170,064, which claims the benefit of prior U.S. Provisional Application No. 61/774,008, filed Mar. 7, 2013.

BACKGROUND OF THE INVENTION

The present invention generally relates to holsters for the carry of pistol magazines, and more particularly, a pistol magazine holster with a snag.

A carrier of a firearm such as a semi-automatic pistol may need a spare magazine should the carrier need additional ammunition, or have a malfunction related to the primary magazine in the pistol. Thus, various magazine holsters have been made available for the carry of pistol magazines.

Many such holsters are designed to carry the magazine on a belt and can be concealed by a garment covering the belt line, such as a coat. Other holsters are designed to be placed within a clothing pocket. Some of these pocket holsters are configured to hold a magazine in a deep section or middle area of a pocket. Others store the magazine for placement into an undefined area of the pocket. Another such pocket holster holds the magazine so that it remains visible partially above the pocket line.

As can be seen, there is a need for an improved pistol magazine holster that allows for discreet carry of a magazine while leaving room in the user's pocket to carry other objects, comfort for the user's leg while sitting and bending, and ease of quick and efficient "draws" of the magazine.

SUMMARY OF THE INVENTION

In one aspect of the present invention, a pistol magazine holster comprises a body capable of retaining a pistol magazine; a support structure coupled to the body and adapted to secure the body to a compartment; and a primary snag member coupled to the body, the primary snag member adapted to retain the body within the compartment.

These and other features, aspects and advantages of the present invention will become better understood with reference to the following drawings, description and claims.

DETAILED DESCRIPTION OF THE INVENTION

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

Various inventive features are described below that can each be used independently of one another or in combination with other features. However, any single inventive feature may not address any of the problems discussed above or may only address one of the problems discussed above. Further, one or more of the problems discussed above may not be fully addressed by any of the features described below.

Broadly, an embodiment of the present invention generally provides a way to comfortably and discreetly carry a spare magazine, such that the magazine is quickly and easily accessible. The magazine holster of some embodiments may be configured to be worn on the inner side of a front pocket near the outside (or lateral) seam of the pocket, and the holster may be equipped with a spring clip. The holster may be configured to remain in the pocket when the magazine is drawn. The holster and clip may be configured such that when attached to a pocket, the body of the holster, along with the magazine held within the body, may be only partially visible from above the pocket line. This visible portion of the holster and magazine may appear to be the top portion of a common pocket knife. The magazine may be quickly and easily drawn from the holster without giving the impression the wearer is carrying a pistol magazine.

The magazine holster of an embodiment of the present invention may be worn on the lateral seam side of a front pocket in the manner of a pocket knife and configured to stay in the pocket while drawing the magazine. Because the holster need not take up the whole pocket, the wearer of the holster may move, bend and sit without hindrance, may quickly draw the magazine, and may disguise the true nature of the magazine.

FIGS. 1-4 show various views of a pistol magazine holster 10 according to an embodiment of the present invention. The holster may include a body 11 capable of retaining a pistol magazine, a support structure 14 coupled to the body 11 and adapted to secure the body 11 to a compartment, and a snag member 12 coupled to the body 11. The snag member 12 may be adapted to retain the body 11 within the compartment.

Figure 5:
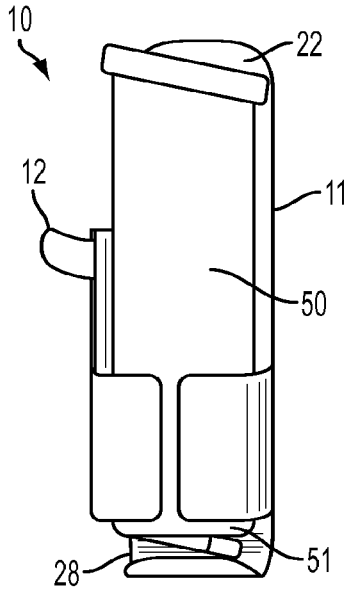
FIG. 5 illustrates a front perspective view of the holster of FIG. 1 including a magazine.
Figure 7:
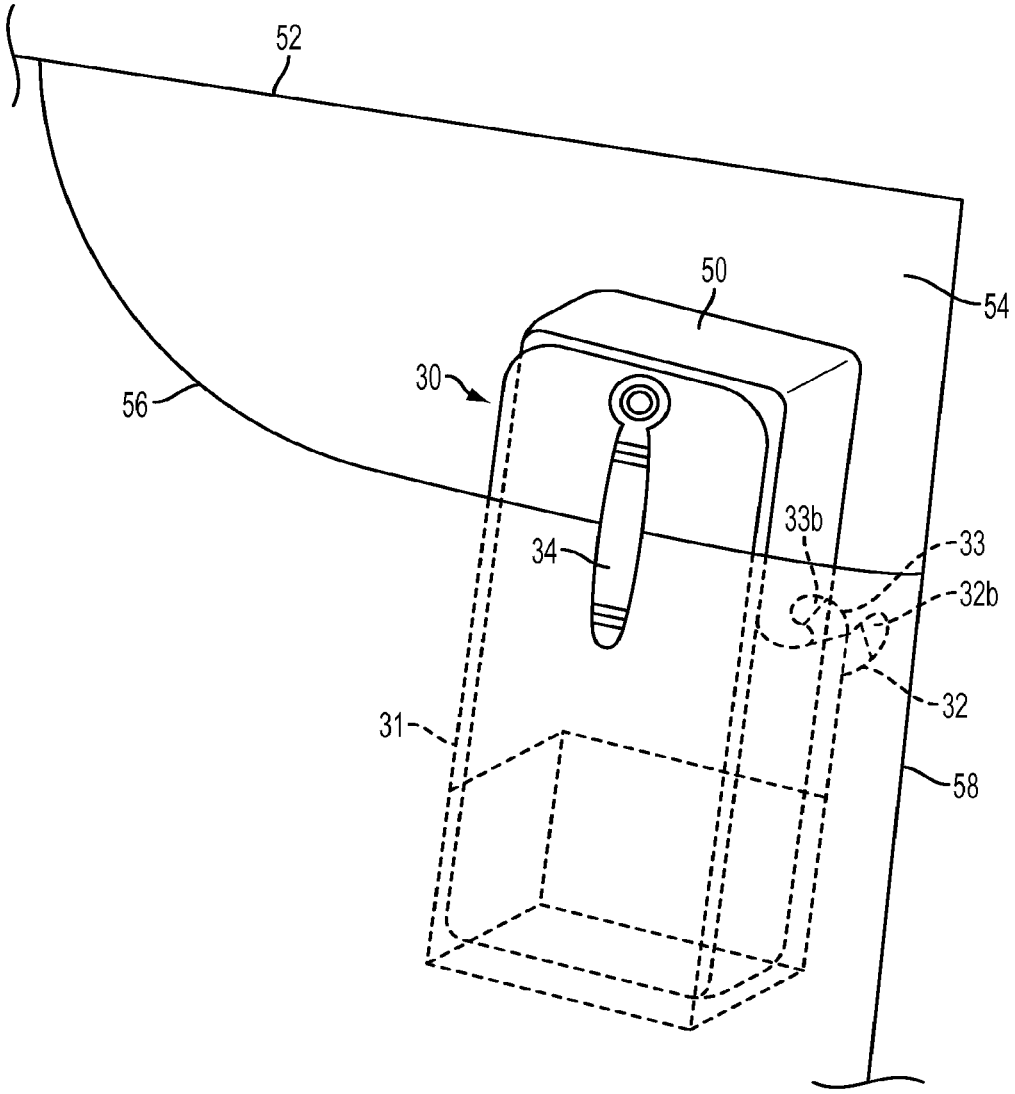
FIG. 7 illustrates the rear view of the holster of FIG. 6 including a magazine, as worn inside a pants pocket.

The body 11 may be configured to hold a pistol magazine 50, as shown in FIG. 5. Body 11 may be made of a rigid material such as, metal or plastic. The top part of body 11 may be configured to resemble a pocket knife when viewed from a rear perspective, such as that shown in FIG. 2. As an example, as shown in the embodiment of FIG. 7, the top portions of holster 30 and magazine 50 may protrude above the top seam of front fabric 56 of pocket 52. From the perspective of a casual viewer, the combination of holster 30 and magazine 50 may appear to be the top a common pocket knife.

The body 11 may include a front portion 20 and a rear portion 22, where the rear portion 22 is opposite the front portion 20. It may include a short side portion 24 and a long side portion 26, both coupled to and adjacent to the front 20 and rear 22 portions, and opposite each other. The height $H_L$ of the long side portion 26 may be greater than the height $H_S$ of the short side portion 24, such that the distance $D_L$, between the tops of rear portion 22 and long side portion 26, is shorter than the distance $D_S$, between the tops of rear portion 22 and short side portion 24. Thus the wearer may comfortably place a thumb along the area above the long side portion 26, and an index finger along the area above the short side portion 24, as in the initial position of a standard magazine draw.

Figure 1:
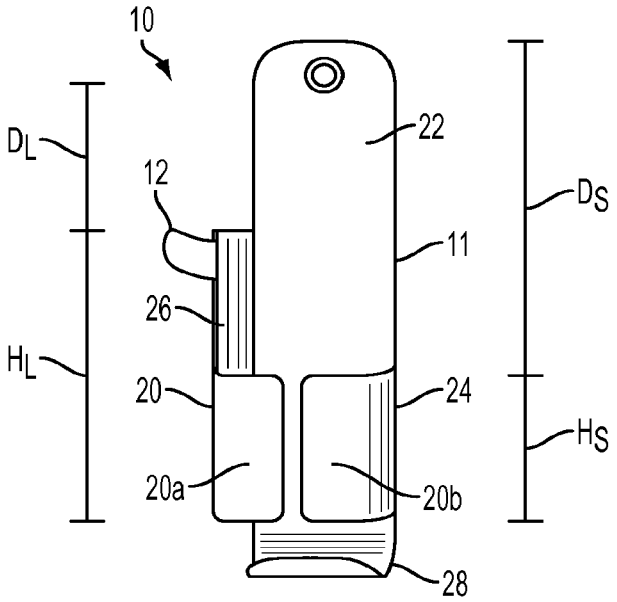
FIG. 1 illustrates a front perspective view of a magazine holster according to an exemplary embodiment of the present invention.

From a front-view perspective as shown in FIG. 1, long side portion 26 may be on the left side of the holster body 11, and short side portion 24 on the right. The illustrated configuration may suit a right-handed pistol user while handling a weapon from the right hand and drawing a magazine with the left. However, it will be understood that the holster 10 may be configured for left handed use as well without departing from the scope of the invention. For example, the side portions 24 and 26 may be switched so as to better suit a left-handed pistol user.

Holster body 11 may also include a bottom portion 28 coupled to any one or more of the front 20, rear 22, short side 24, or long side 26 portions. Bottom portion 28 may be detached from the side portions 24 and 26, and may in some embodiments have a generally curved or hook shape. Bottom portion 28 may be configured to support an end of a pistol magazine 50, as shown in FIG. 5, and may provide for ease of removal of magazine 50 from holster 10. It may also be adapted to protect feed lips 51 of the magazine 50, such as by using rigid material, padding, and/or other materials known to one of ordinary skill in the art.

Figure 6:
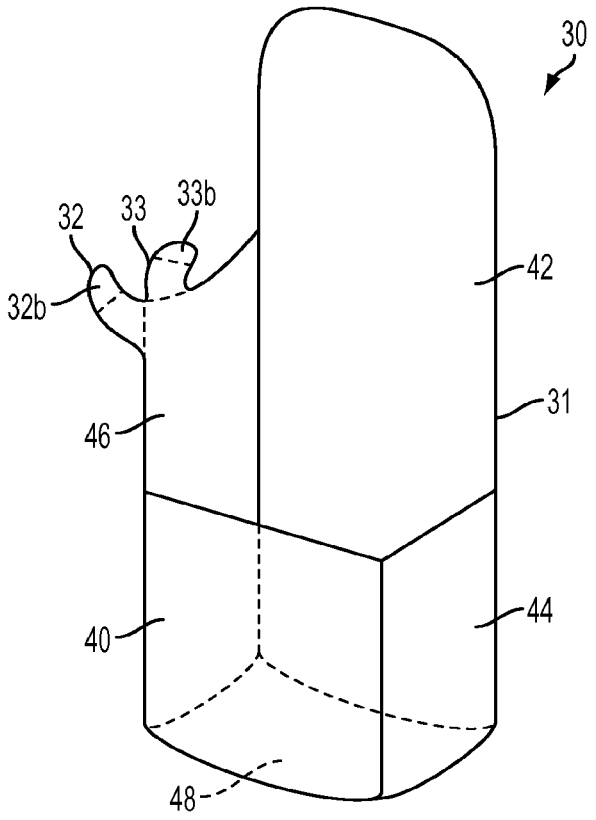
FIG. 6 illustrates a front perspective view of a magazine holster according to another exemplary embodiment of the present invention.

Each of the portions 20, 22, 24, 26, and 28 of the holster body may be formed with, connected to, partially connected to, or disconnected from another portion of the holster body. For example, as shown in FIG. 1, the side portions 24 and 26 may be coupled to the rear portion 22, and also each coupled to parts of front portion 20. Front portion 20 may comprise two parts 20*a* and 20*b*. As shown in FIG. 1, parts 20*a* and 20*b* may be split, such that part 20*a* is coupled to long side portion 26, and part 20*b* is coupled to short side portion 24. Bottom portion 28 may be coupled to rear portion 22 and formed separately from the front 20 and side 24/26 portions. As another example, as shown in the embodiment of FIG. 6, the front 40, rear 42, short side 44, long side 46, and bottom 48 portions of holster body 31 may be formed together.

As shown in FIG. 5, size, shape and design of body 11 may be configured such that a magazine may be placed within body 11 without protruding from the top of rear portion 22 of body 11. Body 11 may also be configured such that an end of a magazine may sit below or protrude above the top edge of rear portion 22. The size and proportions of the various elements of holster 10 may vary to adapt to different models of magazines.

Figure 2:
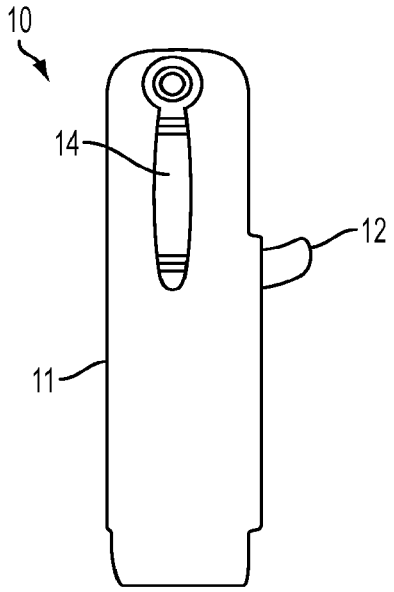
FIG. 2 illustrates a rear view of the holster of FIG. 1.
Figure 3:
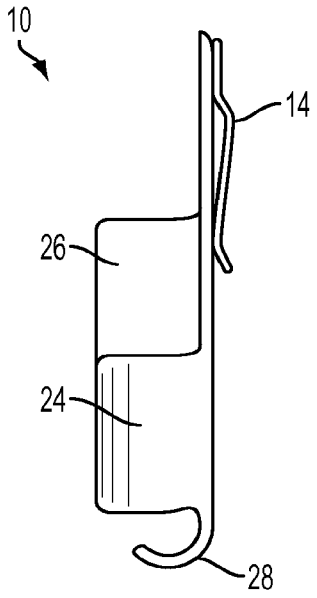
FIG. 3 illustrates a side view of the holster of FIG. 1.
Figure 4:
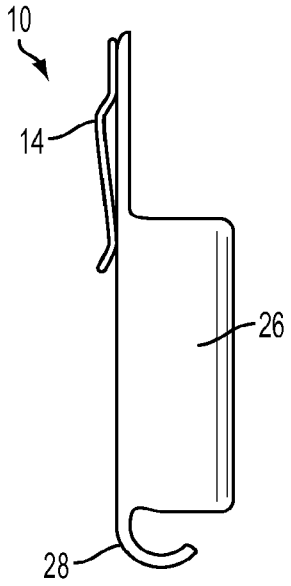
FIG. 4 illustrates an alternative side view of the holster of FIG. 1.

Support structure 14 may be coupled to the body 11, and adapted to secure the body 11 within a compartment such as but not limited to a clothing pocket or bag opening. Support structure 14 may include a spring clip as shown in FIGS. 2-4, or employ other means of supporting the body 11 to a compartment. Support structure 14 may attach to an area of the compartment such that body 11 is secured within the compartment in a substantially upright position. Support structure 14 may, for example, be coupled to the front portion 20 of body 11 such that at least the top portion of holster 10 resembles a pocket knife from the rear view, as shown in FIG. 2. The support structure 14 may be adapted to secure the body 11 such that the snag member 12 may hook against a section of the pocket or other compartment in response to pressure associated with removal of the pistol magazine.

The snag member 12 may be coupled to body 11 (as shown in FIGS. 1 and 2), to support structure 14, or to both. Snag member 12 may be adapted to retain body 11 within a compartment, such as a pants pocket, in which body 11 is placed, and may protrude orthogonally outward from body 11 towards a surface of the compartment. As an example, in securing holster 10 onto a user's front pants pocket, supporting structure 14 may hold body 11 in a substantially upright position, with snag member 12 protruding towards the lateral seam of the pants pocket. As the user draws a pistol magazine upward and out of holster 10, snag member 12 may aid in keeping body 11 secured in the pocket by hooking against the inner fabric of the pocket in response.

Figure 1B:
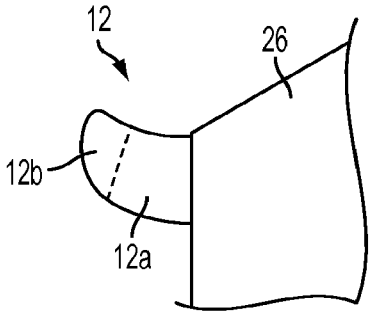
FIG. 1B illustrates a partial close-up view of a snag member of the holster of FIG. 1.

As shown in FIG. 1B, snag member 12 may include a main portion 12*a* and a hook portion 12*b*. An inner side of main portion 12*a* may be coupled to the holster body 11, with an outer side of main portion 12*b* being coupled to hook portion 12*b*. Snag member 12 may be coupled to body 11 at one or more of various areas of body 11, such as but not limited to the long side portion 26, as shown in FIG. 1B. Hook portion 12*b* may be configured to hook against a section of a compartment in which body 11 is placed, in response to pressure associated with removal of the pistol magazine. The snag member 12 may be configured so that the strength of the hooking action is proportional to the amount of pressure a user exerts in the direction of the hook portion 12*b*.

In another embodiment of the invention, shown as pistol magazine holster 30 in FIGS. 6-7, more than one snag member 32-33 may be used, for example, to provide added effectiveness in retaining the body 31 within a compartment during a user's magazine draw. Snag members 32 and 33 may be configured to hook in different directions. As an example, the body 31 of holster 30 may be placed within a user's front pants pocket 52, and secured with clip 34 against front fabric 56. As the user draws magazine 50, a first snag member 32 may hook fabric in a lateral direction toward the side seam 58 of pocket 52, and a second snag member 33 may hook against the rear fabric 54 of pocket 52. The bi-directional hooking action may provide increased security in keeping body 31 within pocket 52.

Snag members 32-33 may be placed close together or coupled to different portions of holster 30, such as but not limited to the long side portion 46 as shown in FIG. 6. Additional snag members may also be employed. Snag members 32-33 may be configured to avoid hooking against the fabric of pocket 52 unless pressure is intentionally exerted by a user, so as to, for example, allow for comfortable wear by the user. For example, the hook portions 32*b*-33*b* may be rounded and/or positioned to hook in an upward direction away from the user's leg, as shown in FIGS. 6-7. However, the placements and directional configurations of the one or more snags in the drawings are shown as an example, and do not serve to limit the invention to any particular configuration.

The form of the one or more snag members is also not limited in any way by that shown in the figures. For example, the outer surfaces, or portions thereof, of the holster may be textured, and/or rubber or other high friction material may be added to the outer surfaces, or portions thereof, in order to aid in keeping the holster in the pocket while the magazine is drawn. The snag member may also employ other configurations, such as but not limited to clips, pins, Velcro, or other materials known to one of ordinary skill in the art.

Although embodiments of the invention have been described in the context of retaining pistol magazines, it is contemplated that other articles may be carried by the holster embodiments of the invention. One such article may include a "speed strip", which is a vertical ammunition clip for reloading revolvers. A speed strip may be retained within, and withdrawn from, the body of an embodiment of the invention, in a manner similar to that described for pistol magazines.

It should be understood, of course, that the foregoing relates to exemplary embodiments of the invention and that modifications may be made without departing from the spirit and scope of the invention as set forth in the following claims.

What is claimed is:

1. A pistol magazine holster, comprising:

an elongate body defined by opposing front and rear portions, a first side portion, and an opposed second side portion defining a side thickness, the rear portion of the elongate body further defining a structure coupling point; and a primary snag member coupled to and extending laterally outward from a top end of the first side portion opposite the rear portion of the elongate body as offset by the side thickness and at a central region of the elongate body between the opposite top and bottom ends thereof, the primary snag member being in a substantially orthogonal relation to the elongate body, the primary snag member being vertically offset from the structure coupling point;

wherein the primary snag member is adapted to retain the elongate body within a compartment.

2. The pistol magazine holster of claim 1, wherein the body is rigid.

3. The pistol magazine holster of claim 1, further comprising:

a bottom portion coupled to at least one of the front, rear, first side, or second side portions, and configured to support an end of a pistol magazine;

wherein:

the first side portion is adjacent to the front and rear portions and coupled to at least one of the front portion or rear portion, the second side portion is adjacent to the front and rear portions and coupled to at least one of the front portion or rear portion, the second side portion having a greater height than the first side portion.

4. The pistol magazine holster of claim 3, wherein the bottom portion is rigid.

5. The pistol magazine holster of claim 1, further comprising a clip attached to the structure coupling point.

6. The pistol magazine holster of claim 5, wherein the clip is adapted to secure the elongate body, such that the primary snag member hooks against a section of the compartment in response to pressure associated with removal of the pistol magazine.

7. The pistol magazine holster of claim 1, wherein the primary snag member includes a main portion and a hook portion, the main portion being coupled to the elongate body at a first side and to the hook portion at a second side.

8. The pistol magazine holster of claim 7, wherein the hook portion is configured to hook against a section of the compartment in response to pressure associated with removal of the pistol magazine.

9. The pistol magazine holster of claim 3, wherein the primary snag member is coupled to the second side portion.

10. The pistol magazine holster of claim 1, further comprising:

a secondary snag member coupled to the elongate body.

11. The pistol magazine holster of claim 10, wherein the primary snag member and the secondary snag member are configured to hook in different directions.

12. The pistol magazine holster of claim 5, wherein the clip is compressively engageable to a front panel of the compartment against the elongate body.

13. The pistol magazine holster of claim 12, wherein the primary snag member hooks against an interior portion of either one or both of the front panel and a rear panel of the compartment in response to pressure associated with removal of the pistol magazine.

14. The pistol magazine holster of claim 1, wherein the primary snag member is hooked in an upward direction toward the structure coupling point of the elongate body.

15. The pistol magazine holster of claim 1, wherein at least a portion of an exterior surface of the elongate body has a textured surface.

16. A firearm box magazine holster, comprising:

an elongate body;

a support structure coupled to a rear portion of the elongate body and adapted to secure the elongate body to a compartment; and a primary snag member coupled to and extending laterally outward from a top end of a long side portion of the elongate body opposite the rear portion thereof and offset by a side thickness and at a central region of the elongate body between opposite top and bottom ends thereof, the primary snag member being in a substantially orthogonal relation to the elongate body and to the support structure;

wherein the primary snag member is adapted to retain the elongate body within the compartment, and the long side has a greater height than the short side.

17. The firearm box magazine holster of claim 16, wherein the support structure is coupled to the rear portion of the elongate body at a structure coupling point thereof.

18. The firearm box magazine holster of claim 17, wherein the primary snag member is vertically offset from the structure coupling point.

* * * * *